US011350757B2

(12) United States Patent
Kong

(10) Patent No.: US 11,350,757 B2
(45) Date of Patent: Jun. 7, 2022

(54) SYSTEMS AND METHODS FOR A ROLLAWAY FOLDING BED

(71) Applicant: GoPlus Corp., Fontana, CA (US)

(72) Inventor: Xujuan Kong, Ningbo (CN)

(73) Assignee: GoPlus Corp., Fontana, CA (US)

( * ) Notice: Subject to any disclaimer, the term of this patent is extended or adjusted under 35 U.S.C. 154(b) by 0 days.

(21) Appl. No.: 16/926,378

(22) Filed: Jul. 10, 2020

(65) Prior Publication Data

US 2022/0007844 A1 Jan. 13, 2022

(51) Int. Cl.
*A47C 19/12* (2006.01)
*A47C 19/02* (2006.01)

(52) U.S. Cl.
CPC ..... *A47C 19/122* (2013.01); *A47C 19/024* (2013.01); *A47C 19/025* (2013.01)

(58) Field of Classification Search
CPC ... A47C 19/122; A47C 19/025; A47C 19/024; A47C 19/12; A47C 19/14; A47C 19/027; A47C 17/70; A47C 17/82; A61G 7/005; A61G 7/002; B60B 33/0078
See application file for complete search history.

(56) References Cited

U.S. PATENT DOCUMENTS 1,474,200 A * 11/1923 McKellar ..... A47C 19/122 5/152
1,541,105 A * 6/1925 Broome ..... A47C 19/122 5/151
2,773,269 A * 12/1956 Holt ..... A47C 19/122 5/152
3,456,269 A * 7/1969 Goodman ..... A47C 19/122 5/618
4,048,683 A * 9/1977 Chen ..... A47C 19/122 5/174
9,107,781 B1 * 8/2015 Edgerton ..... A61G 7/012
(Continued)

FOREIGN PATENT DOCUMENTS

| | | |
|---|---|---|
| CN | 210842369 U | 6/2020 |
| JP | S61107350 U | 7/1986 |
| JP | H10192100 A | 7/1998 |

OTHER PUBLICATIONS

Extended European Search Report dated Nov. 26, 2021 from corresponding European Application No. 21183565.7.

*Primary Examiner* — Robert G Santos
*Assistant Examiner* — Alison N Labarge
(74) *Attorney, Agent, or Firm* — Troutman Pepper Hamilton Sanders LLP

(57) ABSTRACT

Systems and methods for use of a rollaway folding bed system are described. The rollaway folding bed system can include a mattress and a frame configured to be moveable between a deployed state and a stored state. The rollaway folding bed can include a rigid frame and sections of support grid affixed to the bars to provide support to the mattress. The rigid frame can also have moveable supports that can moved between a folded position and a stored position. The rigid frame can include central supports having hinges to facilitate moving the rollaway folding bed from a stored position and a deployed position. The crossbars can include lockable wheels affixed at opposing ends of the cross bars and positioned beyond an outer edge of the rollaway folding bed system when in a stored position to provide stability to the rollaway folding bed system.

20 Claims, 8 Drawing Sheets

(56) References Cited

U.S. PATENT DOCUMENTS

| | | | | |
|---|---|---|---|---|
| 9,144,409 | B1 * | 9/2015 | Ocel | A61B 5/055 |
| 2006/0267295 | A1 * | 11/2006 | You | B60B 33/0078 280/5.28 |
| 2016/0287460 | A1 * | 10/2016 | Tekulve | A61G 7/015 |
| 2018/0110339 | A1 * | 4/2018 | Moon | A47C 19/028 |

* cited by examiner

SYSTEMS AND METHODS FOR A ROLLAWAY FOLDING BED

FIELD

Examples of the present disclosure relate to beds that can be used for resting, folded and moved for storage.

BACKGROUND

Folding beds are commonly used to provide a convenient sleeping option that can be easily and compactly stored away when not in use. Folding beds are generally designed with a support frame and a mattress that can support a user when in use and then be folded into a compact stored position when no longer in use. Many folding bed support frames include wheels to allow a user to easily move the bed to and from a storage location. These wheels, however, can be troublesome because the wheels do not effectively prevent the folding bed from moving when the folding bed is in use. This can lead to a user inadvertently injuring himself or herself. Furthermore, many folding beds have wheels that are aligned along an outside edge of the folding bed when in a stored position. Aligning the wheels along an outside edge of the folding bed causes the wheelbase of the folding bed to be relatively narrow causing the folding bed to be unstable and more likely to tip over in a stored position.

Folding beds can also be uncomfortable for a user to rest upon. This is generally a result of many folding beds having bars or support beams aligned with a user's shoulders, back, or hips. Furthermore, although some folding beds utilize a support grid made of several smaller rods or wires in a grid pattern, the support grids are generally made in a tight square pattern that can be unnecessarily rigid and cause further discomfort to a user.

These and other problems are addressed by the technology disclosed herein.

SUMMARY

Accordingly, the inventors of this disclosure have recognized that there is a need for the following solution.

In some examples, a rollaway folding bed system can include a rigid frame having bars forming a substantially rectangular shape; a support grid affixed to the bars and configured to support a mattress; outermost vertical supports moveably affixed to the bars and configured to move between a folded position and an extended position such that the outermost vertical supports can be configured to support the bars when in the extended position; and innermost vertical supports affixed to the bars and configured to support the bars The innermost vertical supports can have crossbars affixed to a bottom end of the innermost vertical supports and extend beyond an outer edge of the innermost vertical supports. The innermost vertical supports can also have lockable wheels affixed to the crossbars near opposing ends of the crossbars, such that the lockable wheels are configured to prevent the rollaway folding bed system from moving when in a locked state. The innermost vertical supports can also have a hinges affixed to the innermost vertical supports and to the bars such that the rigid frame can fold at the of hinges between a stored position and a deployed position and, when the rigid frame is in the stored position, the wheels can be positioned beyond an outer edge of the bars.

The rollaway folding bed system can have a mattress and the rigid frame that can be configured to support the mattress. The rollaway folding bed system can also have retention bars affixed to, and extending upwardly from, the bars. The retention bars can restrict movement of the mattress on the rigid support frame. The retention bars can be affixed to the bars near an end of the rectangular shape such that the retention bars can restrict movement of the mattress on the rigid support frame when the rollaway folding bed system is moved between a stored position and a deployed position.

The outermost vertical supports can be configured to lock when in the extended position such that the outermost vertical supports can be prevented from moving between the folded position and the extended position. The outermost vertical supports can lock by fastening a brace to the vertical support or by extending a brace affixed to the outermost vertical support to an extended position.

The outermost vertical supports can have non-slip pads affixed to a bottom surface of the outermost vertical supports. The non-slip pads can to help prevent the rigid frame from sliding horizontally when the rigid frame is in the deployed position and the outermost vertical supports are in the extended position.

The support grid can be or have rods extending between the bars such that a distance between the rods is greater along a length of the rigid frame than a width of the rigid frame. Furthermore, the distance between the rods of the support grid along the length of the rigid frame can be between approximately seven centimeters and 30 centimeters. The support grid can be eleven rods oriented with the length of the rigid frame. Alternatively, or in addition, the support grid can be multiple support grid sections extending along the length of the rigid frame and separated by additional bars. The support grid sections can be five support grid sections.

The rollaway folding bed system can have support brackets affixed to the innermost vertical supports and the bars near the hinge such that the support brackets can position the innermost vertical supports beyond an outer edge of the bars when the rigid frame is in the stored position.

The rollaway folding bed system can have a strap configured to retain the rigid frame in the stored position. The strap can include a buckle, a side release buckle, or any other buckle suitable for the application The rigid frame can be configured to form a substantially triangular shape when in a stored position. Furthermore, when the rigid frame is in the stored position the wheels can be positioned at least approximately two centimeters beyond an outer edge of the bars. The wheels can also be positioned between approximately two centimeters and thirty centimeters beyond an outer edge of the bars when the rigid frame is in the stored position. Alternatively, a distance between an outer edge of the bars and the wheels when the rigid frame is in the stored position can be adjusted.

Other examples can include a rollaway folding bed system having a mattress and a rigid frame configured to support the mattress. The rigid frame can have a base frame movably connected to, and positioned between, two side frames.

The base frame can have central bars forming a substantially rectangular shape, and a first support grid affixed to the central bars and configured to support the mattress. The base frame can also have vertical supports affixed to, and extending downwardly from, the central bars as well as crossbars affixed proximate a bottom end of the vertical supports. The crossbars can extend beyond an outer edge of the central bars. The base frame can also have lockable wheels affixed to the crossbars proximate an end of the crossbars such that lockable wheels can be positioned beyond an outer edge of the central bars and the lockable wheels can be configured to prevent the rollaway folding bed from moving when in a locked state.

The two side frames can have outer bars forming a substantially rectangular shape and a second support grid affixed to the outer bars and configured to support the mattress. The two side frames can also have outermost vertical supports moveably connected to the outer bars such that the outermost vertical supports can rotate between a folded position and an extended position. The outermost vertical supports can also support the outer bars when in the extended position.

The two side frames can also have hinges affixed to the base frame and the two side frames. The hinges can be configured to facilitate rotation of the two side frames between a stored position and a deployed position and the lockable wheels can be positioned beyond an outer edge of the outer bars when the two side frames are in the stored position.

The outermost vertical supports can lock when in the extended position such that when the outermost vertical supports are locked, the outermost vertical supports can be prevented from moving between the folded position and the extended position. The outermost vertical supports can also haven non-slip pads configured to prevent the rollaway folding bed from moving when the two side frames are in the deployed position and the outermost vertical supports are in the extended position.

The rollaway folding bed system can also have retention bars affixed to, and extending upwardly from, an outer end of the two side frames such that the retention bars can restrict movement of the mattress on the rigid frame. The retention bars can also restrict movement of the mattress on the rigid frame when the rollaway folding bed system is moved between a stored position and a deployed position.

The two side frames can also include a third support grid affixed to the outer bars and configured to support the mattress. The first support grid and the second support grid can each include rods such that a distance between the rods is greater along a length of the rigid frame than a width of the rigid frame. The distance between the rods along the length of the rigid frame can be between approximately six centimeters and thirty centimeters. The first support grid and the second support grid can each have eleven rods oriented with the length of the rigid frame.

The rollaway folding bed system can also have support brackets affixed to the vertical supports and the central bars near the hinge such that the support brackets can be configured to position the vertical supports beyond an outer edge of the outer bars when the two side frames are in the stored position.

The rollaway folding bed system can also have a strap configured to retain the rigid frame in the stored position. The strap can have a buckle such as a side release buckle.

The rigid frame can be configured to form a substantially triangular shape when in a stored position. Furthermore, the rigid frame can be configured such that, when the rigid frame is in the stored position, the lockable wheels are positioned at least approximately two centimeters beyond an outer edge of the outer bars. For example, the lockable wheels can be positioned between approximately two centimeters and thirty centimeters beyond an outer edge of the outer bars when the rigid frame is in the stored position. Furthermore, a distance between an outer edge of the bars and the wheels, when the rigid frame is in the stored position, can be adjusted.

In some examples, a method of moving a rollaway folding bed system to a stored position can include gripping and lifting a first side frame to rotate the first side upward from a substantially horizontal position to a substantially vertical position. The method can include pushing the first side frame toward the center of a base frame until the first side frame has rotated beyond the vertical position. Similarly, the method can include gripping and lifting a second side frame to rotate the second side frame upward from a substantially horizontal position to a substantially vertical position and pushing the second side frame toward the center of the base frame until the second side frame has rotated beyond the vertical position. Optionally, the method can include continuing to push the second side frame toward the center of the base frame until opposing ends of a mattress contact each other proximate a top end of the first and second side frames. For rollaway folding bed systems that include a strap, the method can include fastening a strap connecting the first and second side frames to secure the first and second side frames in place.

The present disclosure will be more fully understood from the following detailed description of embodiments thereof, taken together with the drawings.

BRIEF DESCRIPTION OF THE DRAWINGS

While the specification concludes with claims, which particularly point out and distinctly claim the subject matter described herein, it is believed the subject matter will be better understood from the following description in conjunction with the accompanying drawings, in which like numerals indicate like structural elements and features in various figures. The drawings are not necessarily to scale, emphasis instead being placed upon illustrating principles of the disclosure. The figures depict one or more implementations of the inventive devices, by way of example only, not by way of limitation.

DETAILED DESCRIPTION

The features of the presently disclosed solution may be economically manufactured or assembled by using one or more distinct parts and associated components which, may be assembled together for removable or integral application. Unless defined otherwise, all terms of art, notations and other scientific terms or terminology used herein have the same meaning as is commonly understood by one of ordinary skill in the art to which this disclosure belongs.

In some cases, terms with commonly understood meanings are defined herein for clarity and/or for ready reference, and the inclusion of such definitions herein should not necessarily be construed to represent a substantial difference over what is generally understood in the art.

As used herein, "a" or "an" means "at least one" or "one or more." As used herein, the term "user", "subject", "end-user" or the like is not limited to a specific entity or person.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the current technology can include a variety of combinations and/or integrations of the embodiments described herein.

As used herein, the terms "about" or "approximately" for any numerical values or ranges indicate a suitable dimensional tolerance that allows the part or collection of components to function for its intended purpose as described herein. More specifically, "about" or "approximately" may refer to the range of values ±20% of the recited value, e.g. "about 90%" may refer to the range of values from 71% to 99%.

Although several components are described herein as being a "bar," the term should not be limited to a specific type of bar. For example, the term "bar" as used herein can refer to a solid or a hollow piece of material having any shape. Furthermore, the term "bar" does not refer to any specific type of material but can refer to any of the materials discussed herein and others not discussed.

Figure 1A:
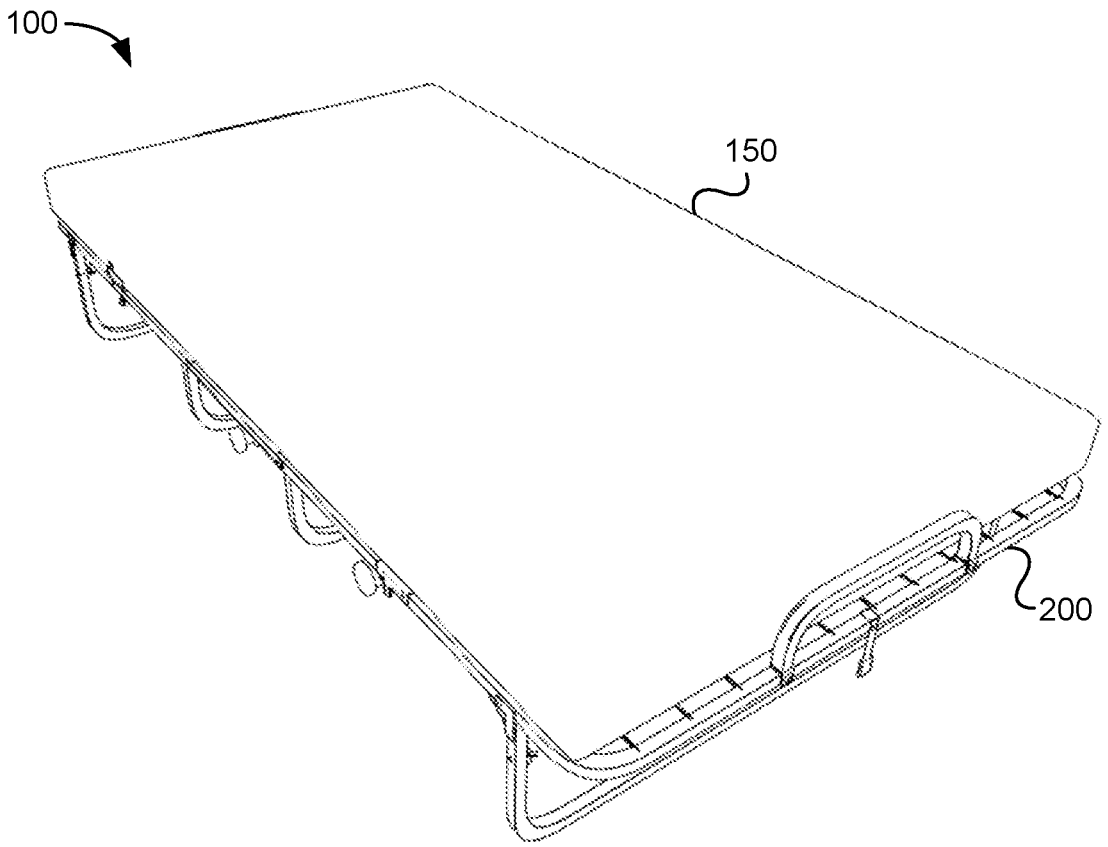
FIG. 1A is a top isometric view of an exemplary rollaway folding bed system in a deployed position, according to an example of the present disclosure.
Figure 1B:
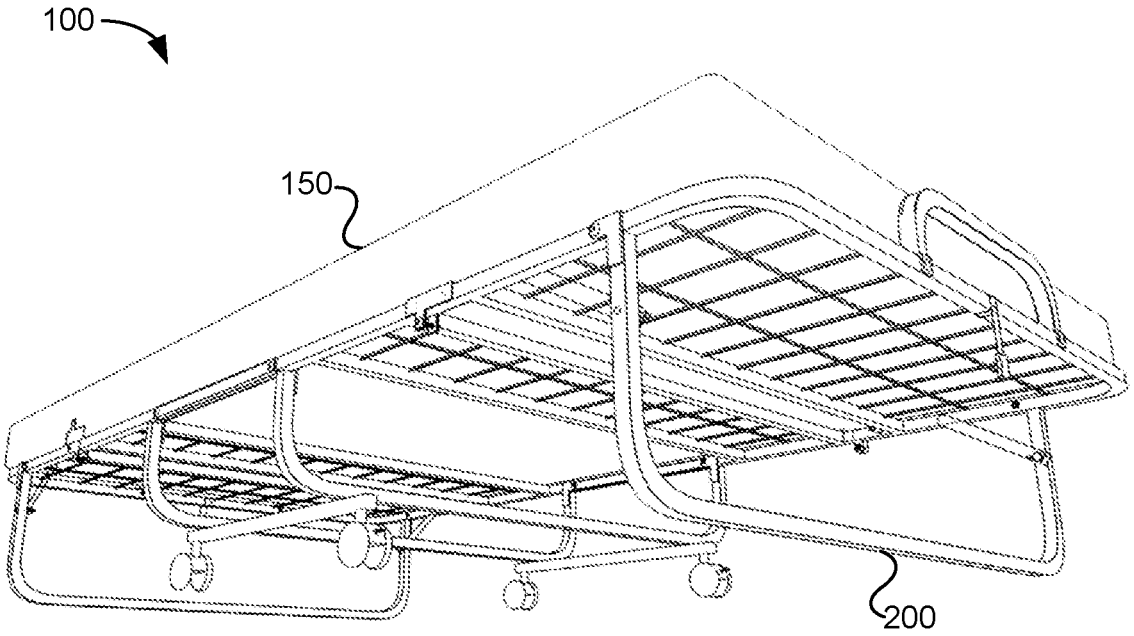
FIG. 1B is a bottom isometric view of an exemplary rollaway folding bed system in a deployed position, according to an example of the present disclosure.
Figure 2A:
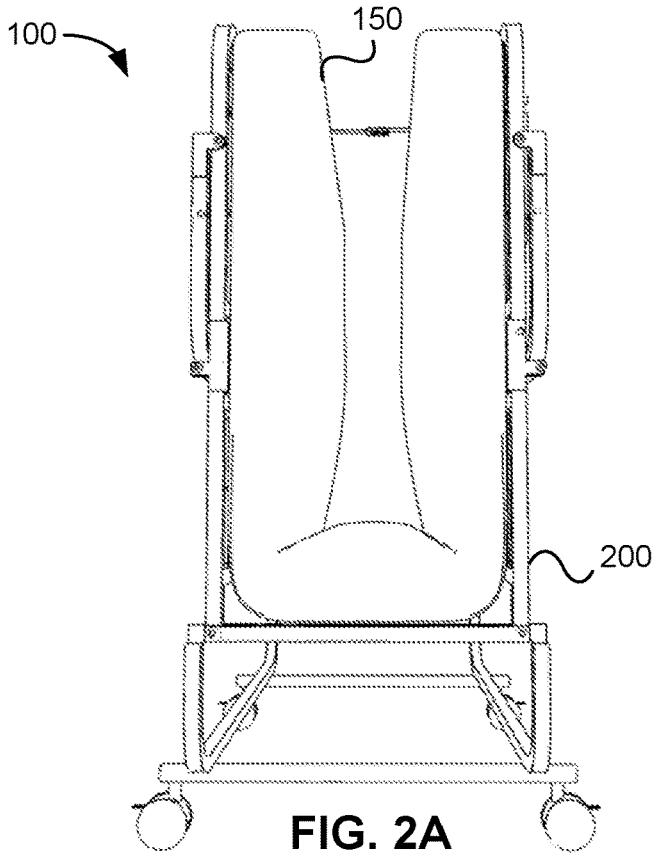
FIG. 2A is a side view of an exemplary rollaway folding bed system in a stored position, according to an example of the present disclosure.
Figure 2B:
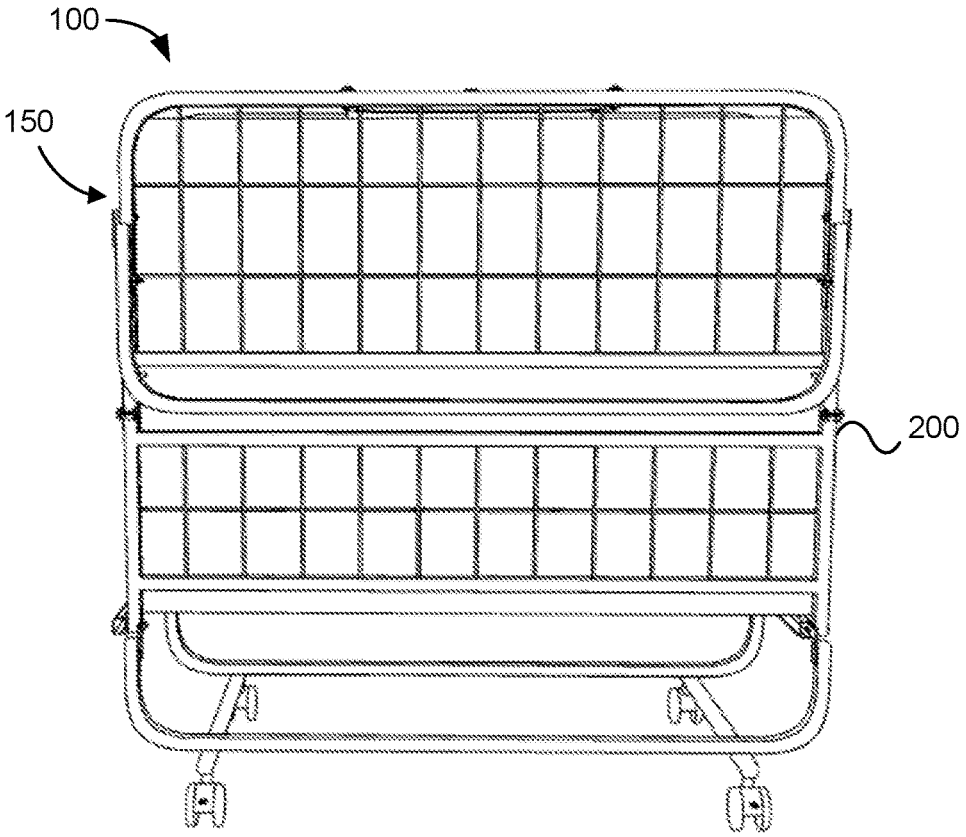
FIG. 2B is a rear view of an exemplary rollaway folding bed system in a stored position, according to an example of the present disclosure.

The solution of this disclosure resolves the problems in the art by providing a folding bed that can prevent movement of the folding bed while in a deployed position, prevent the folding bed from tipping over when moved in a stored position, and provide a comfortable sleeping option for a user. Turning to the drawings, FIG. 1A is a top isometric view and FIG. 1B is a bottom isometric view of an exemplary rollaway folding bed system 100 in a deployed position, according to an example of the present disclosure. As depicted in FIGS. 1A and 1B, the rollaway folding bed system 100 can have a mattress 150 and a frame 200. In a deployed position, the rollaway folding bed system 100 can be configured to support a user. The user, for example, can rest upon the rollaway folding bed system 100 when tired or otherwise needing a comfortable place to lie down. As will be appreciated, the frame 200 can be configured to support the mattress 150 and the user while the mattress 150 can be configured to provide a comfortable layer of supporting material to help provide comfort to the user. The rollaway folding bed system 100 can also be folded to a stored position as depicted in FIG. 2A and FIG. 2B. In a stored position, the rollaway folding bed system 100 can be configured to be easily moved and require less storage space than needed while in a deployed position.

The mattress 150 can be any type of mattress capable of providing support to a user while still allowing the mattress to be folded to a stored position. The mattress 150 can be any size of mattress such as a crib size, single size, twin size, full size, queen size, or even king size mattress. Furthermore, the mattress 150 can be made from manufactured materials such as foam rubber, gel foam, latex, or any other suitable manufactured material. Alternatively, or in addition, the mattress 150 can be made from natural materials such as cotton, wool, straw, hemp, or any other suitable natural material. Furthermore, the mattress 150 can have an inner-spring support system and have a quilted or otherwise sewn outer cover. The mattress 150 can be sized to provide adequate support to a user while also ensuring that the mattress 150 can be folded with the rollaway folding bed system 100 when in a stored position.

Figure 3A:
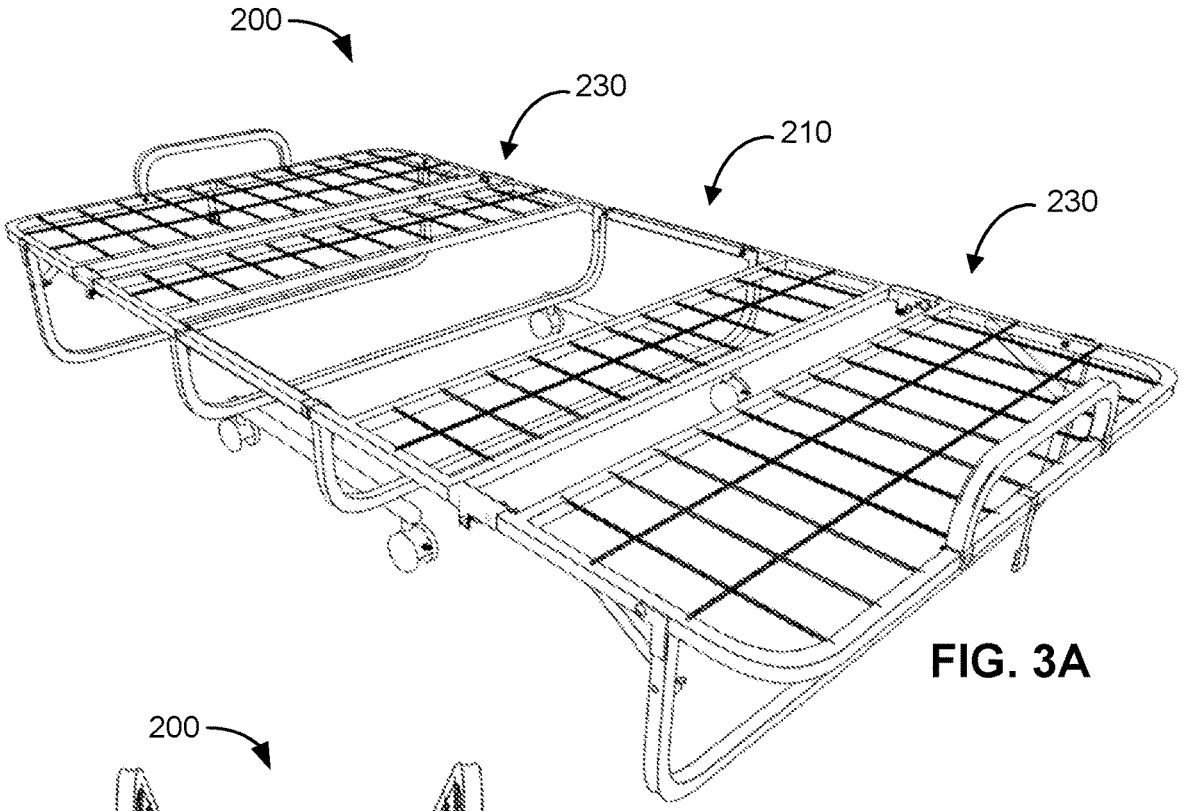
FIG. 3A is a top isometric view of an exemplary rollaway folding bed frame in a deployed position, according to an example of the present disclosure.
Figure 3B:
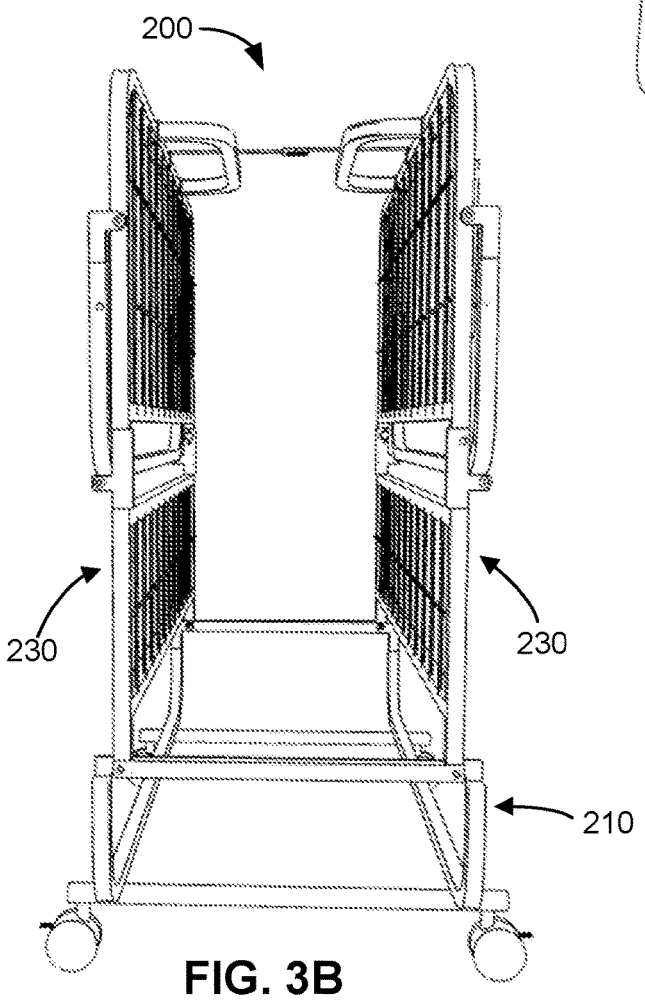
FIG. 3B is a side view of an exemplary rollaway folding bed frame in a stored position, according to an example of the present disclosure.

The frame 200, as will be described in greater detail herein, can be made to support the mattress 150 and a user when in the deployed position and be folded, or otherwise collapsed, to a stored position so that the rollaway folding bed system 100 can be easily stored. As depicted in FIG. 3A and FIG. 3B, the frame 200 can comprise a base frame 210 and two side frames 230. The two side frames 230 can be moveable affixed to the base frame 210 such that the two side frames 230 can be moved from a deployed position to a stored position. When in the deployed position, the two side frames 230 can be substantially beside or next to the base frame 210 (as depicted in FIG. 3A). When in a stored position, the two side frames 230 can be substantially above or atop the base frame 210 (as depicted in FIG. 3B).

The frame 200 can be made of materials capable of supporting the mattress 150 and a user. For example, the frame 200 can be made of metals, such as aluminum, steel, brass, or any other metallic material suitable for the application. The frame 200 can also be made of other non-metallic materials such as carbon fiber, glass fiber, polymers, or any other non-metallic material suitable for the application. Furthermore, the frame 200, depending on the chosen type of material, can be made from solid pieces of material or hollow pieces of material such as tubing. For example, the frame 200 can be made from steel or aluminum tubing to ensure the frame 200 provides adequate support to the mattress 150 and a user while also remaining light enough for a user to move, set up, and store the rollaway folding bed system 100. The frame 200 can also be made from all of the same materials or the frame 200 can be made from a combination of materials.

The base frame 210 and the two side frames 230 can each comprise several subcomponents as will be described in greater detail in relations to FIGS. 3C and 3D. The several subcomponents can all be made from the materials described previously and can all be the same material or be different materials. Furthermore, unless otherwise noted, the several subcomponents can be joined or affixed together using any suitable method. For example, the several subcomponents of the base frame 210 and the two side frames 230 can be joined with fasteners (e.g., bolts, rivets, screws, etc.), welded, crimped, bonded with adhesives, press fit, brazed, soldered, or any other suitable method of joining or affixing the subcomponents to make the base frame 210 and the two side frames 230. Furthermore, as will be appreciated by those of skill in the art, subcomponents that are intended to move in relation to each other can be moveably joined or affixed to each other using screws, bolts, pins, press fit components, or any other suitable method capable of moveably joining or affixing the subcomponents.

Figure 3C:
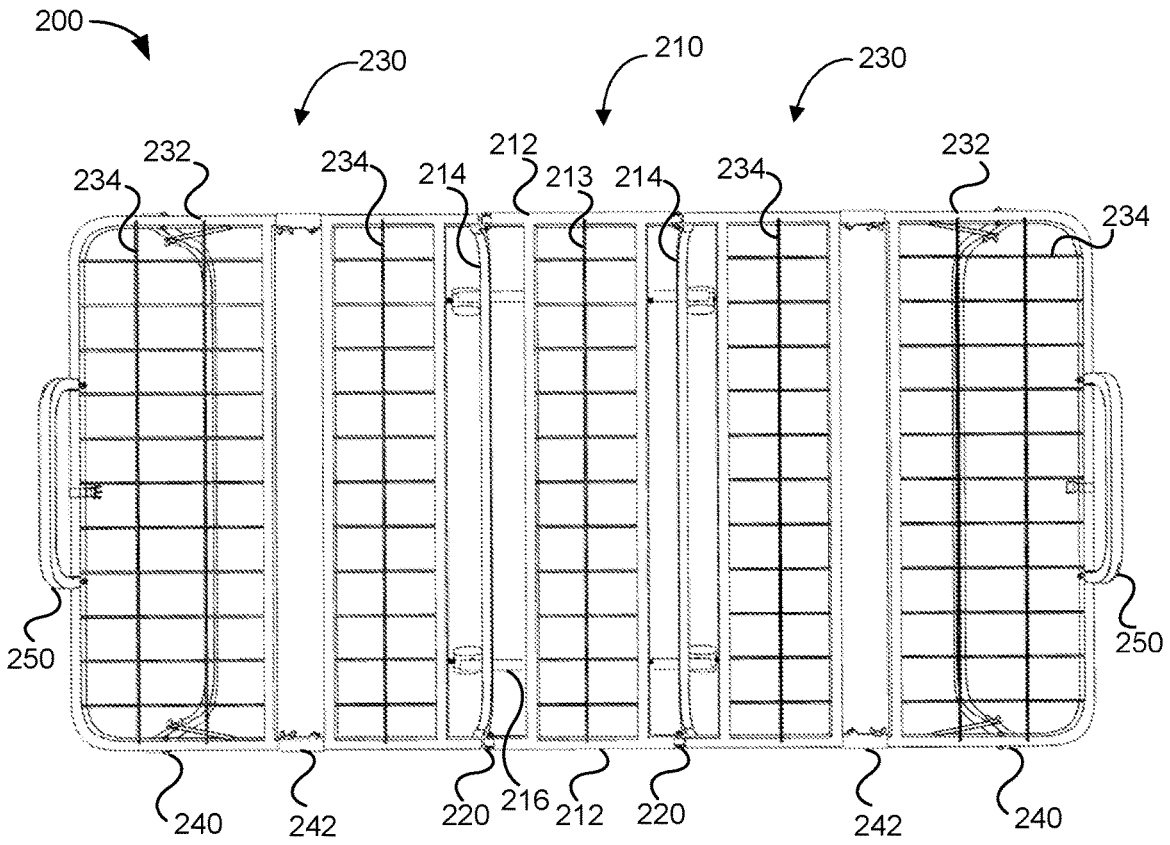
FIG. 3C is a top view of an exemplary rollaway folding bed frame in a deployed position, according to an example of the present disclosure.
Figure 3D:
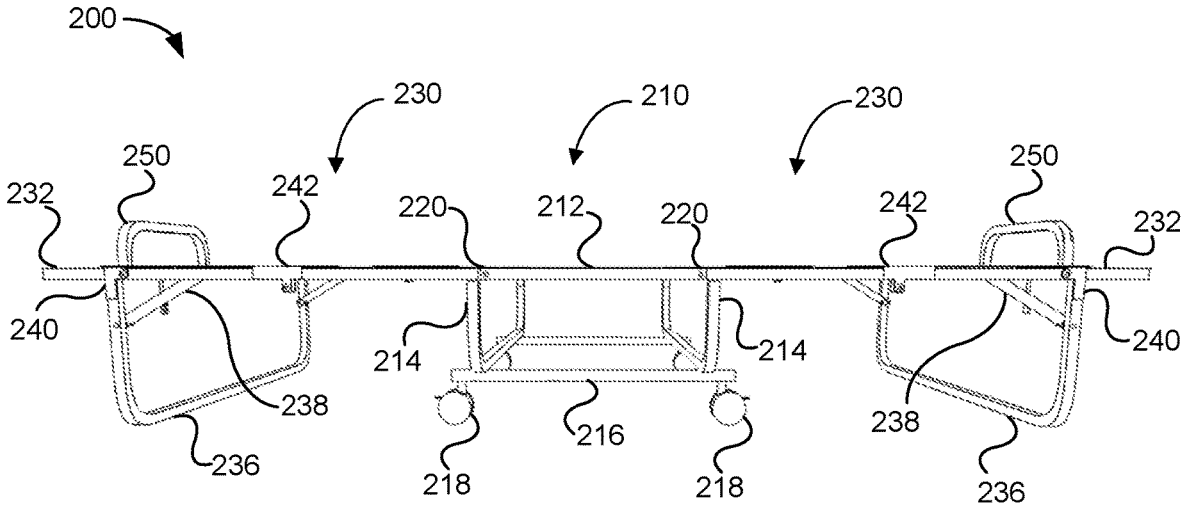
FIG. 3D is a side view of an exemplary rollaway folding bed frame in a deployed position, according to an example of the present disclosure.

FIG. 3C is a top view and FIG. 3D is a sideview of the frame 200 in a deployed position. As depicted in FIG. 3C and FIG. 3D, the base frame 210 of the frame 200 can comprise several subcomponents including upper bars 212, base support grid 213, vertical support bars 214, lower crossbars 216, lockable wheels 218, and connection brackets 220. The base frame 210 can be made to stand upright on the lockable wheels 218 on its own without the two side frames 230 being connected. Furthermore, the base frame 210 can be configured to be strong enough to support the mattress 150 and a user when in a deployed state and the mattress 150 and both side frames 230 when in a stored state. When in a stored state, the base frame 210 can be configured to provide a stable base for supporting the mattress 150 and the two side frames 230 such that the rollaway folding bed system 100 is unlikely to tip over when transported in a stored state.

The upper bars 212 can be a single piece of material configured to provide lateral and vertical support to the rollaway folding bed system 100 by being connected to other components of the frame 200. For example, the upper bars 212 can be connected to the vertical support bars 214 and the two side frames 230 via a connection bracket 220 using any of the previously described connection methods. Furthermore, the upper bars 212 can be sized to create a larger space between the mattress 150 proximate a bottom portion than proximate a top portion when in the stored position. For example, the upper bars 212 can be sized such that two side frames 230 and the base frame 210 form a substantially triangular shape when in the stored position (e.g., opposing ends of the mattress 150 can be in contact with each other while the center of the mattress is not in contact or folded over on itself when in the stored position). In one example, the two side frames 230 and the base frame 210 can form a substantially triangular shape when in the stored position having a base of approximately thirty-six centimeters and two sides of approximately seventy-four centimeters with the tops of the two sides substantially intersecting.

The upper bars 212 can include portions extending across the width of the frame 200 connecting two outer portions of the upper bars 212. The portions extending across the width of the frame 200 can strengthen the frame 200 by forming a rigid rectangular frame. Connected to the upper bars 212 can be a base support grid 213 configured to provide support to the mattress 150 and a user. The base support grid 213 can comprise several rods or bars joined together, using any of the previously described methods, to create a grid pattern. The base support grid 213 can form several rectangular cells that are spaced a sufficient distance such that the support grid can provide support for the mattress 150 and user without being unnecessarily rigid. In this way, the base support grid 213 can help to provide the user with a more comfortable user experience. As an example, the base support grid 213 can comprise eleven equally spaced bars or rods oriented with the length of the frame 200 and equally spaced across the width of the frame 200. The eleven equally spaced bars or rods can be joined by one or more bars or rods oriented with the width of the frame 200 and stretching across the width of the frame 200. As another example, the base support grid 213 can include rods crossing each other to form twenty-four individual cells stretched between the upper bars 212. In some examples, the base support grid 213 can have an overall length of ninety-two centimeters and a width of twenty-five centimeters with each cell having a length of approximately twelve and a half centimeters and a width of approximately eight centimeters. As will be appreciated, the dimension of the base support grid 213 can vary depending on the application and size of the frame 200.

The vertical support bars 214 can each be made from a continuous piece of material formed to extend across the width of the frame 200 while also turning upwards to provide vertical support to the frame 200. For example, the vertical support bars 214 can be formed from a continuous bar that is bent near the ends to form a horizontal portion and two vertical portions on either end of the horizontal portion. Alternatively, the vertical support bars 214 can be multiple pieces of material joined together to form a horizontal portion with two vertical portions near the ends. The vertical support bars 214 can be joined to the connection brackets 220 using any of the previously described connection methods.

Lower crossbars 216 can be affixed to the vertical support bars 214 proximate a bottom portion of the vertical support bars 214 using any of the previously described connection methods. By connecting the lower crossbars 216 to the vertical support bars 214, the lower crossbars 216 can provide additional support to the base frame 210. Furthermore, the lower crossbars 216 can be connected to lockable wheels 218 to allow the rollaway folding bed system 100 to be easily moved by a user.

The lower crossbars 216 can be configured to extend past the vertical support bars 214 such that outer ends of the lower crossbars 216 extend beyond outer ends of the two vertical support bars 214 as depicted in FIGS. 3B and 3C. With this configuration, the lower crossbars 216 can be configured to position the lockable wheels 218 farther apart from each other such that the lockable wheels 218 can be positioned beyond an outer edge of the two side frames 230 when the two side frames 230 are in the stored position. Thus, the lower crossbars 216 can help to create a wider and more stable wheelbase. Having a wider and more stable wheelbase can help to make the rollaway folding bed system 100 more stable and less likely to tip over when moved by a user. The lower crossbars 216, for example, can be configured to extend anywhere from approximately two and a half centimeters to more than approximately thirty centimeters beyond an outer edge of the two side frames 230 when in the stored position. In one example, the lower crossbars 216 can have an overall length of approximately fifty centimeters and extend approximately four centimeters beyond an outer edge of the two side frames 230 when in the stored position. Furthermore, as will be appreciated by those of skill in the art, the length of the lower crossbars 216 can vary or otherwise be adjusted by the end-user depending on the overall size of the rollaway folding bed system 100. For example, for smaller rollaway folding bed systems 100 configured for a crib- or single-sized mattress, the lower crossbars 216 can be configured to extend only approximately one centimeter or approximately a few centimeters beyond an outer edge of the two side frames 230 when in a stored position. Whereas, for larger rollaway folding bed systems 100 configured to hold a king- or queen-sized mattress, the lower crossbars 216 can be configured to extend more than approximately thirty centimeters beyond an outer edge of the two side frames 230 when in a stored position.

The lower crossbars 216 can also be configured such that the position of the lockable wheels 218 can be adjusted depending on the application. For example, the lower crossbars 216 can have holes, slots, brackets, or other adjustable connection points such that the position of the lockable wheels 218 can be adjusted as desired.

As just described, the lockable wheels 218 can be connected to the lower crossbars 216 near an end of the lower crossbars 216. The lockable wheels 218 can be any type of wheel configured to allow the rollaway folding bed system 100 to roll when pushed by a user. This can include solid wheels, inflated wheels, stem casters, plate casters, leveling casters, side mount casters, or any other suitable type of wheel or caster for the application. The lockable wheels 218 can be mounted such that they are allowed to swivel or rotate to facilitate movement of the rollaway folding bed system 100 in any horizontal direction. Alternatively, the lockable wheels 218 can comprise two swiveling wheels and two non-swiveling wheels such that only one end of the rollaway folding bed system 100 is able to be pushed or pulled in any horizontal direction and the other end of the rollaway folding bed system 100 can only be pushed or pulled forward or backward, but the rollaway folding bed system 100 can still be guided in a desired direction.

The lockable wheels 218 can also be configured to have a brake to prevent horizontal movement of the rollaway folding bed system 100 when the brake is applied. For example, the lockable wheels 218 can have a side lock brake, a face contact brake, a total lock brake, a floor lock brake, a compression or decompression brake, or any other type of brake suitable for the application. By applying the brake, the rollaway folding bed system 100 can be prevented from easily moving at times when it is desirable for the rollaway folding bed system 100 to remain stationary, such as when in a deployed state or in a stored location. In this way, a user can remove the brake only when moving the rollaway bed system 100 but keep the brake applied during other times.

The connection brackets 220 can be a single piece of material affixed to the upper bars 212 and the vertical support bars 214. The connection brackets 220 can be configured to position the vertical support bars 214 beyond an outer edge of the two side frames 230 when in a stored position by providing a space between an end of the upper bar where the side frame 230 is connected (as described in greater detail herein and depicted in FIGS. 4A-4C) and the vertical support bar 214. As will be appreciated, by providing a space between an end of the upper bar where the side frame 230 is connected and the vertical support bar 214, the connection bracket 220 can position the lockable wheels 218 even farther beyond an outer edge of the two side frames 230 when in the stored position. This can help to make the base frame 210 capable of providing even more stability to the rollaway folding bed system 100 when in a stored position.

Figure 4A:
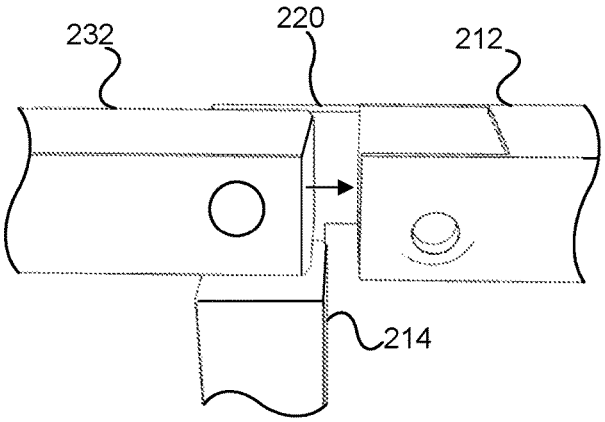
FIG. 4A is a top isometric close-up view of an exemplary hinge and bracket for a rollaway folding bed frame, according to an example of the present disclosure.
Figure 4B:
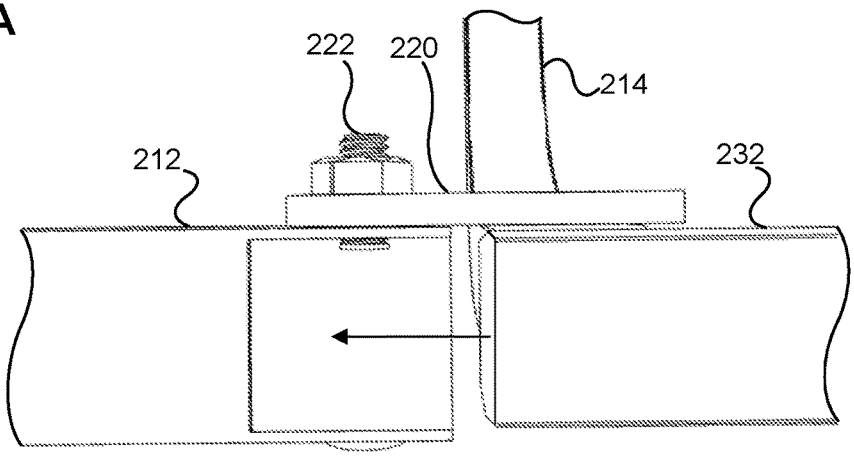
FIG. 4B is a top close-up view of an exemplary hinge and bracket for a rollaway folding bed frame, according to an example of the present disclosure.
Figure 4C:
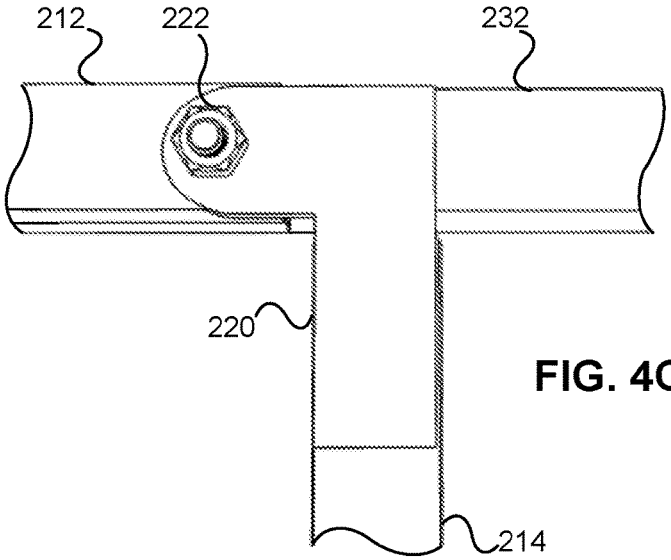
FIG. 4C is a side close-up view of an exemplary hinge and bracket for a rollaway folding bed frame, according to an example of the present disclosure.

As depicted in FIGS. 4A-4C, the connection bracket 220 can be mounted to the side of the vertical support bars 214 and the upper bars 212. The connection bracket 220 can include a hole or bore through an end of the connection bracket 220 configured to receive a fastener 222 such as a bolt, pin, screw, or other fastener. The fastener 222 can be mounted through a hole of the upper bars 212 and a hole of the outer upper bars 232 of the two side frames 230 to create a hinge such that the outer upper bars 232 can rotate about the fastener 222 in relation to the upper bars 212. As will be appreciated by one of skill in the art, the outer upper bars 232 are shown removed from the connection point where the fastener 222 would be inserted through the outer upper bars in FIGS. 4A-4B to show the hole proximate the end of the outer upper bar 232. However, as indicated by the arrow in FIGS. 4A-4B, one of skill in the art will understand that the hole in the outer upper bars 232 can be aligned with the hole in the upper bars to allow the fastener 222 to be inserted. Furthermore, as will be appreciated, the hole of the outer upper bars 232 can be the same size or a larger size than the hole of the upper bars 212 to allow the outer upper bars to rotate about the fastener 222.

Returning now to FIG. 3C and FIG. 3D, the two side frames 230 can have outer upper bars 232, support grids 234, support legs 236, support leg braces 238, support leg brackets 240, outer upper bar brackets 242, and retention bars 250. As previously discussed, the two side frames 230 can be moveably connected to the base frame 210 via the connection bracket 220 and fastener 222. In this configuration, the two side frames 230 can rotate about the fastener 222 from a substantially horizontal deployed position to a substantially vertical stored position.

The outer upper bars 232 can each be a single piece of material configured to provide lateral and vertical support to the rollaway folding bed system 100 by being connected to other components of the frame 200. For example, the outer upper bars 232 can be connected to the base frame 210 via the connection bracket 220 and to the support legs 236 to provide a horizontal frame configured to support to the mattress 150 and a user. Alternatively, the outer upper bars 232 can comprise more than one outer upper bar 232 joined together via an outer upper bar bracket 242. By including outer upper bar brackets 242, the outer upper bars 232 can be folded alongside each other to form a more compact arrangement during, for example, shipping or storage. As will be appreciated, in systems that have outer upper bar brackets 242, the outer upper bars 232 can generally remain in an extended position both when the rollaway folding bed system 100 is in a storage position and in a deployed position.

Figure 5A:
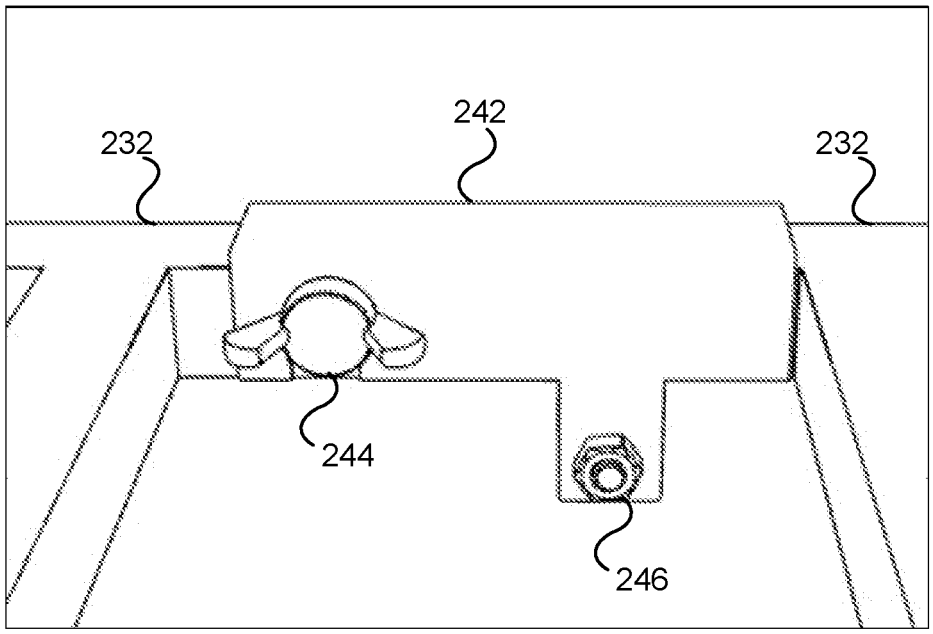
FIG. 5A is a top isometric close-up view of an exemplary bracket and hinge for a rollaway folding bed system, according to an example of the present disclosure.
Figure 5B:
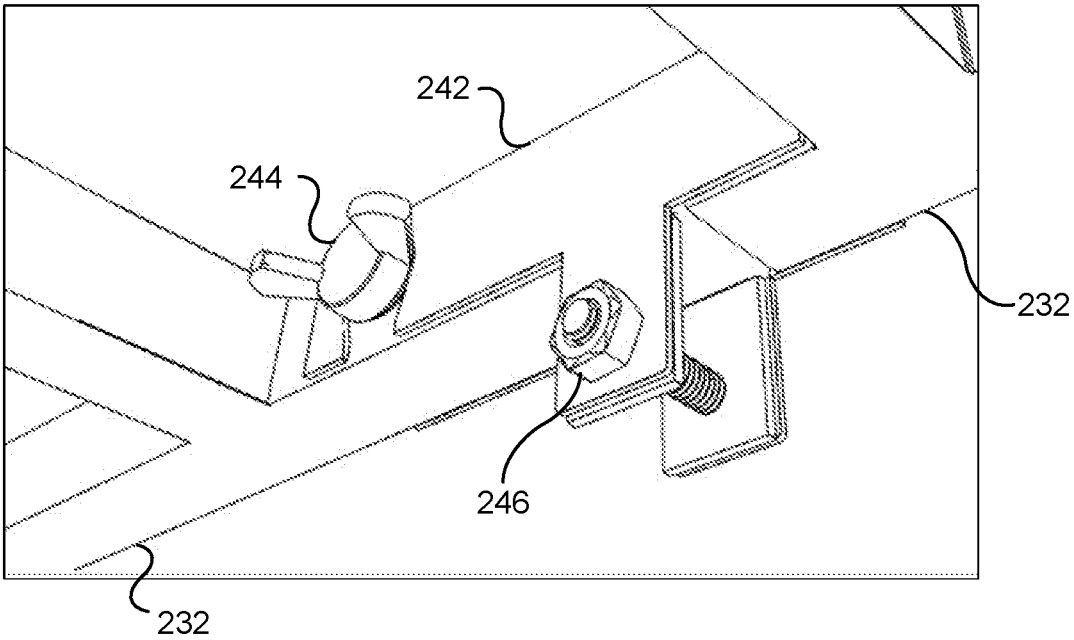
FIG. 5B is a bottom isometric close-up view of an exemplary bracket and hinge for a rollaway folding bed system, according to an example of the present disclosure.

As depicted in FIGS. 5A and 5B, the outer upper bar brackets 242 can include an easily-removeable fastener, such as the wing nut fastener 244 shown, and a second fastener, such as the bolt fastener 246 shown. The outer upper bars 232 can be configured to pivot around the bolt fastener 246 and be locked in place with the wing nut faster 244. As used herein, the word "lock" can include tightening or fastening the component referred to such that the component is prevented from moving unless the component, or corresponding components, is/are loosened or unfastened. The outer upper bar bracket 242 can also be configured to provide support to the upper edge of the outer upper bars 232 such that the outer upper bar bracket 242 can provide strength and distribute a load applied to the outer upper bars 232.

The outer upper bars 232 can include a portion extending around the perimeter of the side frame 230 and additional sections stretching across the width of the frame 200. The portions extending across the width of the frame 200 can strengthen the frame 200 by forming a rigid rectangular frame portions. Connected to the outer upper bars 232 can be a support grid 234 configured to provide support to the mattress 150 and a user similar to the base support grid 213. The support grid 234 can comprise several rods or bars joined together, using any of the previously described methods, to create a grid pattern. The support grid 234 can form several rectangular cells that are spaced a sufficient distance such that the support grid can provide support for the mattress and user without being unnecessarily rigid or firm. In this way, the support grid 234 can help to provide the user with a more comfortable experience. For example, the support grid 234 can comprise eleven equally spaced bars or rods oriented with the width of the frame 200 and spaced across the width of the frame 200. The eleven equally spaced bars or rods can be joined by one or more bars or rods oriented with the width of the frame 200 and stretching across the width of the frame 200.

As another example, the support grid 234 can include two support grids 234 on a single side frame 230. One of the two support grids 234 can include rods crossing each other to form twenty-four individual cells stretched between the outer upper bars 232 while the other of the two support grids 234 can include rods crossing each other to form thirty-size individual cells stretched between the outer upper bars 232. In one example, a support grid 234 nearest the base frame 210 can have an overall length of approximately ninety-two centimeters and a width of approximately twenty-five centimeters with each cell having a length of approximately twelve and a half centimeters and a width of approximately eight centimeters. The second support grid 234 farthest from the base frame 210 can have an overall length of approximately ninety-two centimeters and a width of approximately thirty-one centimeters with each cell having a length of approximately ten centimeters and a width of approximately eight centimeters. As will be appreciated, the dimension of the support grid 234 can vary depending on the application and size of the frame 200.

The support legs 236 can each be made from a continuous piece of material formed to extend across the width of the frame 200 while also turning upwards to provide a vertical support to the frame 200. For example, the support legs 236 can be formed from a continuous bar that is bent near the ends to form a horizontal portion and two vertical portions on either end of the horizontal portion. Alternatively, the support legs 236 can be multiple pieces of material joined together to form a horizontal portion with two vertical portions near the ends.

The support legs 236 can be moveably joined to the outer upper bars 232 via support leg brackets 240 using any of the previously described connection methods. By being moveably connected to the outer upper bars 232 via support leg brackets 240, the support legs 236 can be configured to move from a folded stored position to an extended deployed position. As depicted in FIG. 6C showing a side view of the support leg bracket 240, the support leg bracket 240 can be affixed to a side of the support leg 236 and include a support leg bracket fastener 241 configured to facilitate the support leg 236 to rotate about the support leg bracket fastener 241 in relation to the outer upper bars 232. Furthermore, because the support leg bracket 240 is affixed to a side of the support leg 236 and to a side of the outer upper bars 232, the support leg bracket 240 can be configured to position the support leg 236 beneath the outer upper bar 232 when in an extended position such that a weight applied to the outer upper bar 232 can be distributed to the support leg 236 without creating an unnecessarily large moment force. The support legs 236 can be substantially parallel to the outer upper bars 232 when in the stored position and substantially perpendicular to the outer upper bars 232 when in the deployed position. In this way, the support legs 236 can be compactly stored when not needed but be deployed when needed to support the frame 200.

Figure 6A:
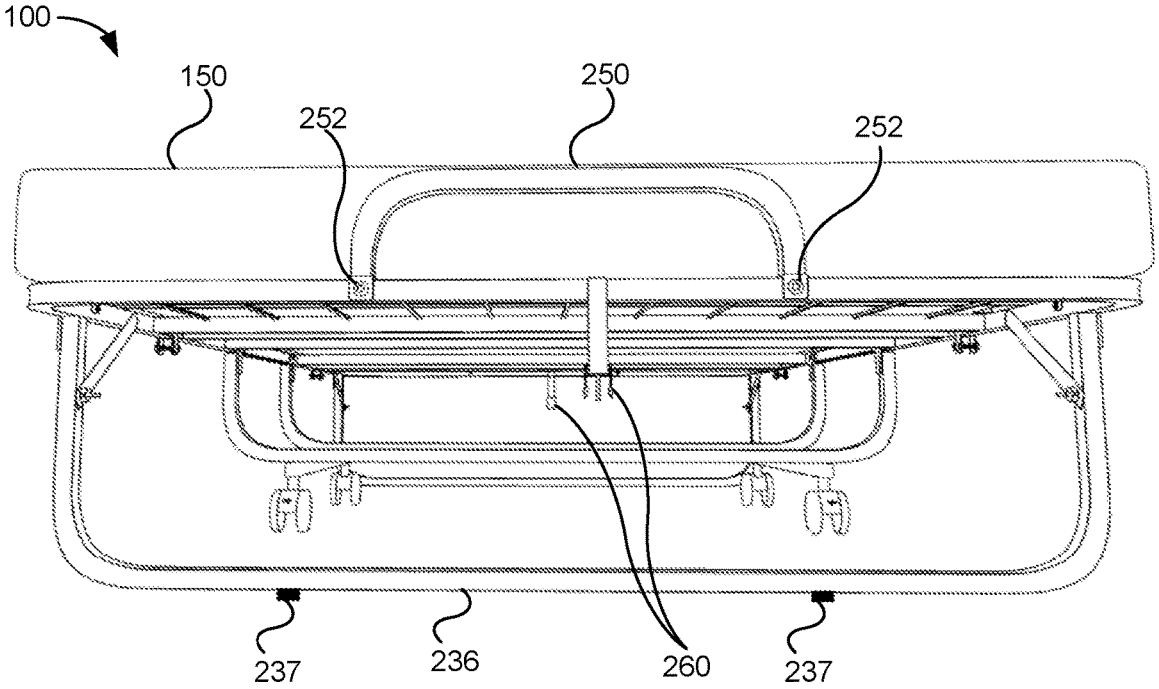
FIG. 6A is a front view of an exemplary rollaway folding bed system in a deployed position, according to an example of the present disclosure.

The support legs 236 can be configured to have non-slip pads 237 affixed to the support legs 236 as depicted in FIG. 6A. The non-slip pads 237 can be affixed to a bottom surface or otherwise configured to provide traction between the support legs 236 and a surface the support legs 236 rest upon when in the stored position. By incorporating non-slip pads 237, the rollaway folding bed system 100 can be safer for a user to rest upon than other rollaway folding beds lacking non-slip pads. As will be appreciated, the non-slip pads can help to prevent the rollaway folding bed system 100 from moving when in the deployed position which can help to avoid a user injuring himself or herself as the bed moves when he or she attempts to use the rollaway folding bed system 100.

Figure 6B:
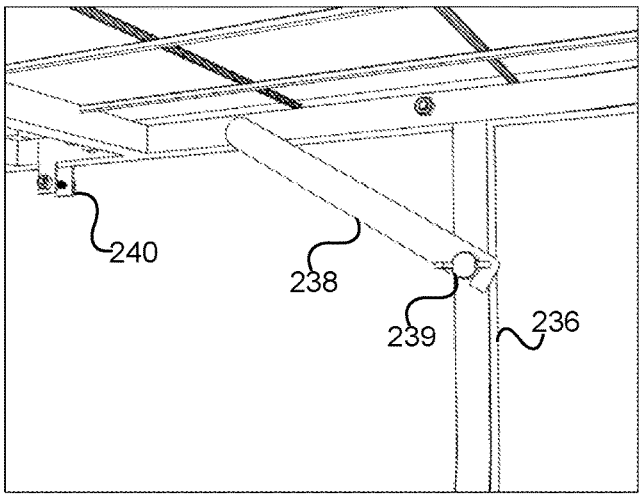
FIG. 6B is an isometric detail close-up view of an exemplary rollaway folding bed frame, according to an example of the present disclosure.
Figure 6C:
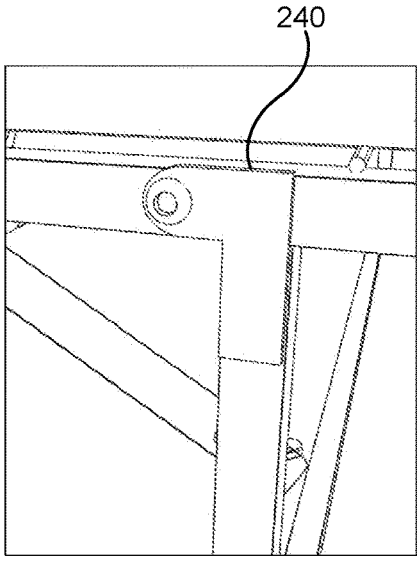
FIG. 6C is another isometric detail close-up view of an exemplary rollaway folding bed frame, according to an example of the present disclosure.

The support legs 236 can have support leg braces 238, as depicted in FIG. 6B, to distribute a load applied to the support leg 236. The support leg braces 238 can be a bar or rod moveably affixed to the outer upper bars 232 and removably connected to the support legs 236. The support leg braces 238, for example and as depicted in FIG. 6B, can be removably connected to the support legs 236 via a fastener, such as a bolt and wing nut 239. As one of skill in the art will appreciate, the support leg braces 238 can comprise many different forms to provide support to the support legs 236. For example, the support leg braces 238 can also be configured to be rotatably connected to the support leg 236 and be removably connected to the outer upper bars 232. Alternatively, the support leg braces 238 can be rotatably connected to the outer upper bars 232 and the support legs 236 and have a pinned joint in the middle that can allow the support leg brace 238 to bend in the middle. In this configuration, the pinned joint can be configured to lock the support leg brace in an extended position to provide support to the support legs 236.

As depicted in FIG. 6A, the rollaway folding bed system 100 can include a retention bar 250 located at opposite ends of the rollaway folding bed system 100. The retention bar 250 can be a single piece of material bent to shape or it can be multiple pieces of material connected using any of the previously described methods. The retention bar 250 can help to retain the mattress 150 on the frame 200 in both the deployed position and the stored position. For example, the retention bar 250 can help to prevent the mattress from sliding along the length of the frame 200 such that a user is unlikely to push the mattress 150 off the frame 200 when using the rollaway folding bed system 100 in the deployed position. Furthermore, the retention bar 250 can help to retain the mattress on the frame 200 when a user lifts the two side frames 210 to move the rollway folding bed system 100 to the stored position. For example, when a user lifts a side frame 230 to move the rollaway folding bed system 100 to a stored position, the retention bar 250 can prevent the mattress 150 from sliding off the frame 200.

The retention bars 250 can be affixed or connected to the outer upper bars 232 using any of the previously described methods. For example, and not limitation, the retention bars 250 can be affixed to the outer upper bars 232 using a fastener 252 as shown in FIG. 6A.

The rollaway folding bed system 100 can include a strap 260 having two pieces of material affixed to opposite ends of the frame 200 as shown in FIG. 6A. The strap 260 can be used to keep the rollaway folding bed system 100 in the stored position such that the two side frames 210 are prevented from moving downward to a deployed position. The strap 260 can be a flexible material such as a rope, chain, strap, cord, or any other suitable piece of flexible material. Alternatively, the strap 260 can be pieces of rigid material such as metal, polymer, composites, or any other suitable piece of rigid material. The strap 260 can include a buckle such as a cam buckle, a ratchet buckle, a roller buckle, a side release buckle, a slide buckle, a snap buckle, at tie buckle, or any other suitable type of buckle. Alternatively, the two portions of strap 260 can simply be configured to be tied by a user to retain the rollaway folding bed system 100 in the stored position. As yet another example, the strap 260 can be a single piece of material rather than the two pieces of material shown in FIG. 6A. If the strap 260 is a single piece of material, the strap 260 can be affixed to one side frame 230 and configured to be wrapped around the other side frame 230 when in the stored position. Alternatively, the strap 260 can be configured to be removed from the frame 200 when not in use. As will be appreciated by those of skill in the art, the strap 260 can be many different configurations that can retain the rollaway folding bed system 100 in the stored position and be loosened or undone to position the rollaway folding bed system 100 in the deployed position.

Figure 7:
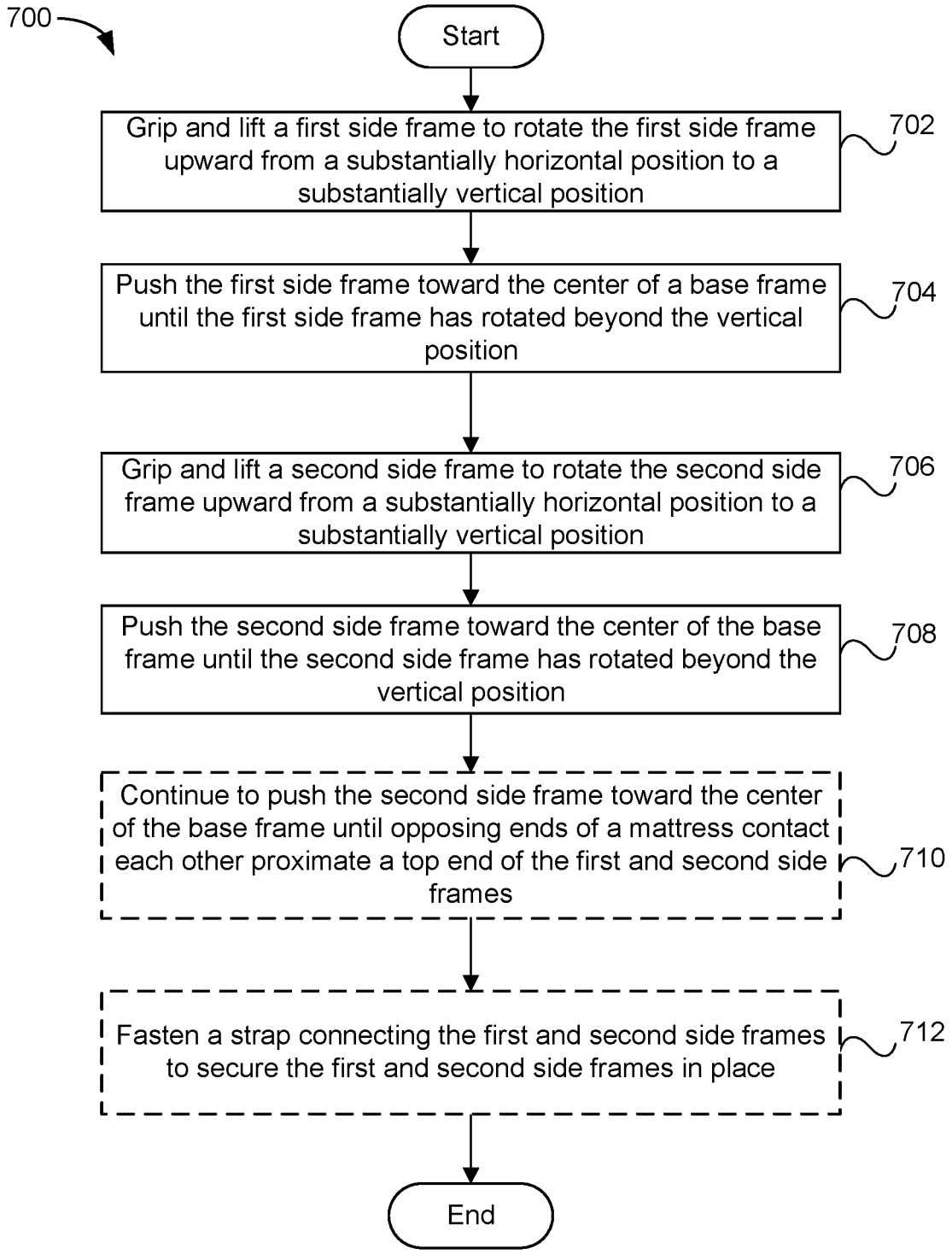
FIG. 7 is a flow diagram illustrating a method of moving a rollaway folding bed system to a stored position, according to an example of the present disclosure.

FIG. 7 is a flow diagram illustrating a method 700 of moving a rollaway folding bed system to a stored position, according to an example of the present disclosure. As depicted in FIG. 7, a method 700 of moving a rollaway folding bed system to a stored position can include gripping and lifting a first side frame 702 to rotate the first side upward from a substantially horizontal position to a substantially vertical position. The method 700 can include pushing the first side frame 704 toward the center of a base frame until the first side frame has rotated beyond the vertical position. Similarly, the method 700 can include gripping and lifting a second side frame 706 to rotate the second side frame upward from a substantially horizontal position to a substantially vertical position and pushing the second side frame 708 toward the center of the base frame until the second side frame has rotated beyond the vertical position. Optionally, the method 700 can include continuing to push the second side frame 710 toward the center of the base frame until opposing ends of a mattress contact each other proximate a top end of the first and second side frames. For rollaway folding bed systems that include a strap (e.g., strap 260), the method 700 can include fastening a strap connecting the first and second side frames to secure the first and second side frames in place. As will be appreciated, the method 700 just described can result in the two side frames and the base frame forming a substantially triangular shape as described herein.

The definitions of the words or elements of the following claims are, therefore, defined in this specification to not only include the combination of elements which are literally set forth. It is also contemplated that an equivalent substitution of two or more elements can be made for any one of the elements in the claims below or that a single element can be substituted for two or more elements in a claim. Although elements can be described above as acting in certain combinations and even initially claimed as such, it is to be expressly understood that one or more elements from a claimed combination can in some cases be excised from the combination and that the claimed combination can be directed to a subcombination or variation of a subcombination(s).

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what incorporates the essential idea of the embodiments.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A rollaway folding bed system, comprising:

a rigid frame comprising:

a plurality of bars forming a substantially rectangular shape;

a support grid affixed to the plurality of bars, the support grid configured to support a mattress;

a plurality of outermost vertical supports moveably affixed to the plurality of bars and configured to move between a folded position and an extended position, wherein the plurality of outermost vertical supports are configured to support the plurality of bars when in the extended position;

a plurality of innermost vertical supports configured to support the plurality of bars;

a plurality of first crossbars attached to the plurality of bars;

a plurality of connection brackets, the plurality of connection brackets connected to the plurality of innermost vertical supports and to the plurality of first crossbars such that the plurality of innermost vertical supports is positioned beyond an outer edge of the plurality of bars;

a plurality of second crossbars affixed proximate to a bottom end of the plurality of innermost vertical supports and extending beyond an outer edge of the plurality of innermost vertical supports;

a plurality of lockable wheels affixed to the plurality of second crossbars proximate opposing ends of the plurality of second crossbars, wherein the lockable wheels are configured to prevent the rollaway folding bed system from moving when in a locked state; and a plurality of hinges affixed to the plurality of connection brackets and to the plurality of bars;

wherein the rigid frame is configured to fold at the plurality of hinges between a stored position and a deployed position, and wherein when the rigid frame is in the stored position the plurality of lockable wheels are positioned beyond an outer edge of the plurality of bars.

2. The rollaway folding bed system of claim 1 further comprising a mattress, wherein the rigid frame is configured to support the mattress.

3. The rollaway folding bed system of claim 2 further comprising a plurality of retention bars affixed to, and extending upwardly from, the plurality of bars, wherein the plurality of retention bars are configured to restrict movement of the mattress on the rigid frame.

4. The rollaway folding bed system of claim 3, wherein the plurality of retention bars are affixed to the plurality of bars proximate an end of the substantially rectangular shape such that the plurality of retention bars are configured to restrict movement of the mattress on the rigid frame when the rollaway folding bed system is moved between a stored position and a deployed position.

5. The rollaway folding bed system of claim 1, wherein the plurality of outermost vertical supports are further configured to lock when in the extended position.

6. The rollaway folding bed system of claim 5, wherein when the plurality of outermost vertical supports are locked, the plurality of outermost vertical supports are prevented from moving between the folded position and the extended position.

7. The rollaway folding bed system of claim 1, the support grid comprising a plurality of rods extending between the plurality of bars, wherein a distance between the plurality of rods is greater along a length of the rigid frame than a width of the rigid frame.

8. The rollaway folding bed system of claim 7, wherein the distance between the plurality of rods along the length of the rigid frame is between approximately six centimeters and thirty centimeters.

9. The rollaway folding bed system of claim 7, wherein the support grid comprises eleven rods oriented with the length of the rigid frame.

10. The rollaway folding bed system of claim 1, wherein the support grid further comprises a plurality of support grid sections extending along a length of the rigid frame and separated by a plurality of additional bars.

11. The rollaway folding bed system of claim 1, wherein a distance between an outer edge of the plurality of bars and the plurality of lockable wheels is at least approximately thirty centimeters when the rigid frame is in the stored position.

12. The rollaway folding bed system of claim 1, wherein the rigid frame is configured to form a substantially triangular shape when in a stored position.

13. The rollaway folding bed system of claim 12, wherein the substantially triangular shape comprises one side having a length of approximately thirty-six centimeters and two sides having lengths of approximately seventy-four centimeters.

14. The rollaway folding bed system of claim 1, wherein when the rigid frame is in the stored position the plurality of lockable wheels are positioned at least approximately two centimeters beyond an outer edge of the plurality of bars.

15. The rollaway folding bed system of claim 1, wherein the second crossbars are configured such that a distance between an outer edge of the plurality of bars and the plurality of lockable wheels is adjustable.

16. A rollaway folding bed system comprising:

a mattress;

a rigid frame configured to support the mattress, the rigid frame comprising:

a base frame movably connected to, and positioned between, two side frames, the base frame comprising:

a plurality of central bars forming a substantially rectangular shape;

a first support grid affixed to the plurality of central bars and configured to support the mattress;

a plurality of vertical supports extending downwardly from the plurality of central bars;

a plurality of connection brackets, the plurality of connection brackets connecting the plurality of vertical supports to the plurality of central bars such that the plurality of vertical supports is positioned beyond an outer edge of the plurality of central bars;

a plurality of crossbars affixed proximate to a bottom end of the plurality of vertical supports, the plurality of crossbars extending beyond an outer edge of the plurality of central bars; and a plurality of lockable wheels affixed to the plurality of crossbars proximate an end of the plurality of crossbars, wherein the plurality of lockable wheels are positioned beyond an outer edge of the plurality of central bars, and wherein the plurality of lockable wheels are configured to prevent the rollaway folding bed from moving when in a locked state;

the two side frames each comprising:

a plurality of outer bars forming a substantially rectangular shape;

a second support grid affixed to the plurality of outer bars and configured to support the mattress; and a plurality of outermost vertical supports moveably connected to the plurality of outer bars, wherein the plurality of outermost vertical supports are each configured to rotate between a folded position and an extended position, and wherein the outermost vertical supports are configured to support the plurality of outer bars when in the extended position;

a plurality of hinges affixed to the base frame and the two side frames, wherein the plurality of hinges are configured to facilitate rotation of the two side frames between a stored position and a deployed position, and wherein the plurality of lockable wheels are positioned beyond an outer edge of the plurality of outer bars when the two side frames are in the stored position.

17. The rollaway folding bed system of claim 16, wherein the plurality of outermost vertical supports are further configured to lock when in the extended position such that when the plurality of outermost vertical supports are locked, the plurality of outermost vertical supports are prevented from moving between the folded position and the extended position.

18. The rollaway folding bed system of claim 16, each of the two side frames further comprising a third support grid affixed to the plurality of outer bars and configured to support the mattress.

19. The rollaway folding bed system of claim 16, the first support grid and the second support grid each comprising a plurality of rods, wherein a distance between the plurality of rods is greater along a length of the rigid frame than a width of the rigid frame.

20. The rollaway folding bed system of claim 19, wherein the first support grid and the second support grid each comprise eleven rods oriented with the length of the rigid frame.

* * * * *